United States Patent [19]

Soden et al.

[11] Patent Number: 4,536,996

[45] Date of Patent: Aug. 27, 1985

[54] BUILDING STRUCTURE

[76] Inventors: Laurence M. Soden, 12 Corrib Heights, 30 Crescent Rd., London, N8; John B. West, Pinehurst, Branksome Part Rd., Camberley, Surrey, both of England

[21] Appl. No.: 467,257

[22] Filed: Feb. 17, 1983

[51] Int. Cl.[3] ..... E04B 1/346

[52] U.S. Cl. ..... 52/67; 52/66; 296/26

[58] Field of Search ..... 52/66, 64, 67; 296/27, 296/26, 165, 171, 175

[56] References Cited

U.S. PATENT DOCUMENTS

| | | | |
|---|---|---|---|
| 2,538,736 | 1/1951 | Spencer | 52/67 X |
| 2,862,253 | 12/1958 | Place et al. | 52/66 |
| 3,508,782 | 4/1970 | Hostetler et al. | 52/66 X |
| 3,612,589 | 10/1971 | Locher | 52/66 X |

FOREIGN PATENT DOCUMENTS

| | | | |
|---|---|---|---|
| 2388963 | 12/1978 | France | 52/66 |
| 661079 | 5/1979 | U.S.S.R. | 52/67 |

*Primary Examiner*—Donald G. Kelly
*Assistant Examiner*—Naoko N. Slack
*Attorney, Agent, or Firm*—Robert Scobey

[57] ABSTRACT

A building structure comprises an outer shell of adjustable dimensions to define a substantially enclosed space. A section at least of the outer shell has a rigid lower frame including structural beams permanently mounted in foundations and defining a lower shell portion. A rigid upper frame defines an upper shell portion and includes structural beams arranged slidably to engage the structural beams of the lower frame. Each of the beams is formed with a longitudinal side flange and is arranged in slidably engagement pairs. Guide means are provided for fitting around the edges of adjacent side flanges of the beams for holding the beams in sliding engagement. Bolts or clamps are provided for fixing the upper portion relative to the lower portion in the raised position at least.

15 Claims, 15 Drawing Figures

74
70
72

BUILDING STRUCTURE

FIELD OF THE INVENTION

This invention concerns building structures.

SUMMARY OF THE INVENTION

More particularly, the invention provides a permanent building structure of adjustable dimensions.

Such a structure has application in various types of building. For example, it may be used in industrial buildings offering office or warehouse space. It may also be employed in buildings for commercial, domestic, horticultural, or leisure purposes.

There are considerable advantages in being able to vary the dimensions of a building as desired. Since the size of the building can be adapted to suit the needs of the occupier, the building will appeal to a wide range of prospective tenants in the first instance and should be easy to sell or let. And, as far as the inhabitants of such a building are concerned, they can alter its size as their requirements change and thereby avoid the problems of finding and moving to different premises.

A building structure in accordance with the invention comprises an outer shell of adjustable dimensions arranged to define a substantially enclosed space, a section at least of the outer shell having a rigid lower portion, a rigid upper portion movable relative to the lower portion between a lowered position in which the two portions overlap to a substantial extent and a raised position in which the two portions overlap to a lesser extent, and means for fixing the upper portion relative to the lower portion in the raised position at least.

The outer shell may have only one adjustable section constituting either the whole or simply a part of the shell. Alternatively, it may have a plurality of independently adjustable sections.

Preferably, the lower and upper portions have structural beams, with the beams of one portion slideably engaging those of the other. In the embodiments described below, the beams of the upper portion are provided by portal frames and the beams of the lower portion constitute stanchions mounted in foundations.

It is a feature of these embodiments that the portal frames and the foundations are so arranged that jacks can be temporarily inserted between them for raising and lowering the upper portion of the outer shell.

The beams may conveniently be H-section in form and, in each engaged pair, the side of one may be held in slidable engagement with the side of the other by one or more guides. For example, the free end of at least one of the two beams may have one, or more than one, guide fixed to it which embraces the other beam in sliding or rolling engagement. Preferably, each guide has a U-shaped section and fits over respective edges of the two beams.

Turning to the means for securing the upper and lower portions relative to one another, these are advantageously employed in the lowered position as well as the raised position for stability. Bolts and/or clamps can conveniently be used for the purpose.

In addition to the structural beams, either or both of the upper and lower portions may also include wind bracing, together with some form of cladding.

The invention is described further by way of example with reference to the accompanying drawings in which:

DESCRIPTION OF THE PREFERRED EMBODIMENTS

Referring initially to FIGS. 1 to 10, these show a building comprising an outer shell 10 which is adjustable as a whole to alter the dimensions of the building. The shell 10 has a fixed, rigid lower portion 12, and a rigid upper portion 14 supported by the lower portion for movement between a lowered position and a raised position.

Figure 3:
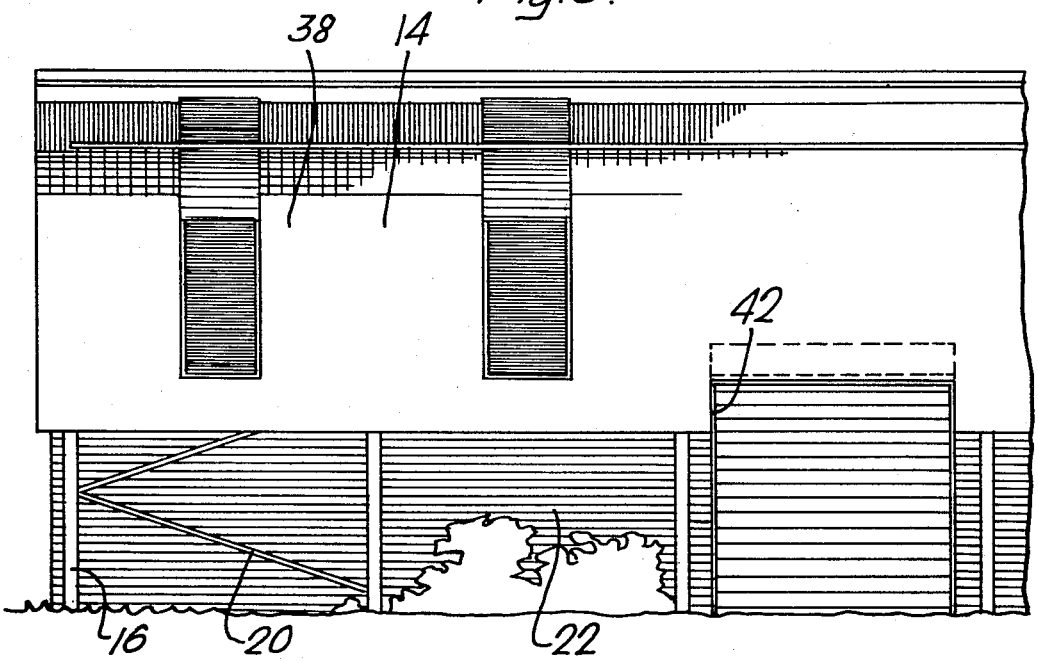
Figure 4:
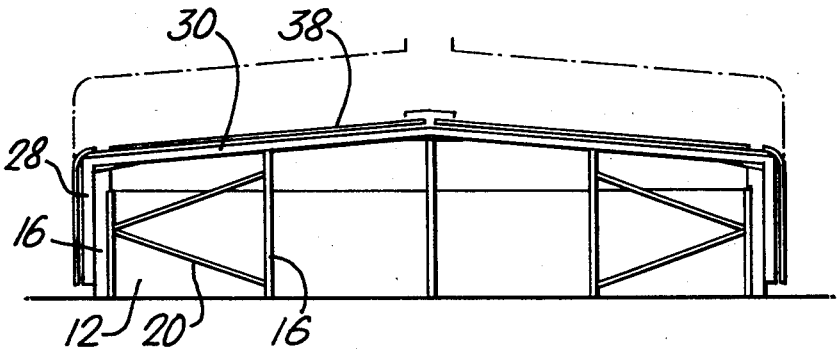
FIGS. 4 and 5 are sectional views of the building in different conditions.
Figure 5:
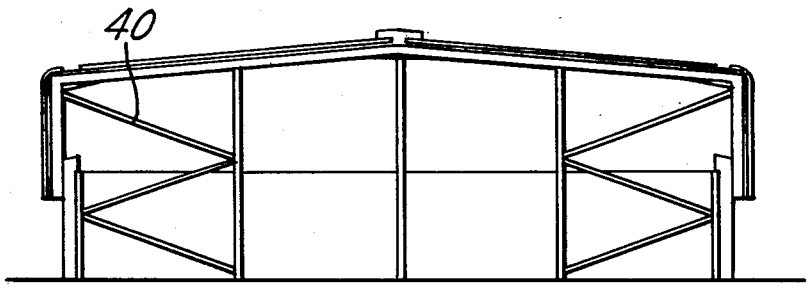

In the lowered position, represented in FIGS. 1, 2, 4 and 6, the two portions overlap to a substantial extent. They still overlap in the raised position, as illustrated in FIGS. 3, 5 and 7, but only to a much lesser extent. Consequently, they define an interior space which remains permanently substantially enclosed apart from points of access such as doors and windows.

Figure 6:
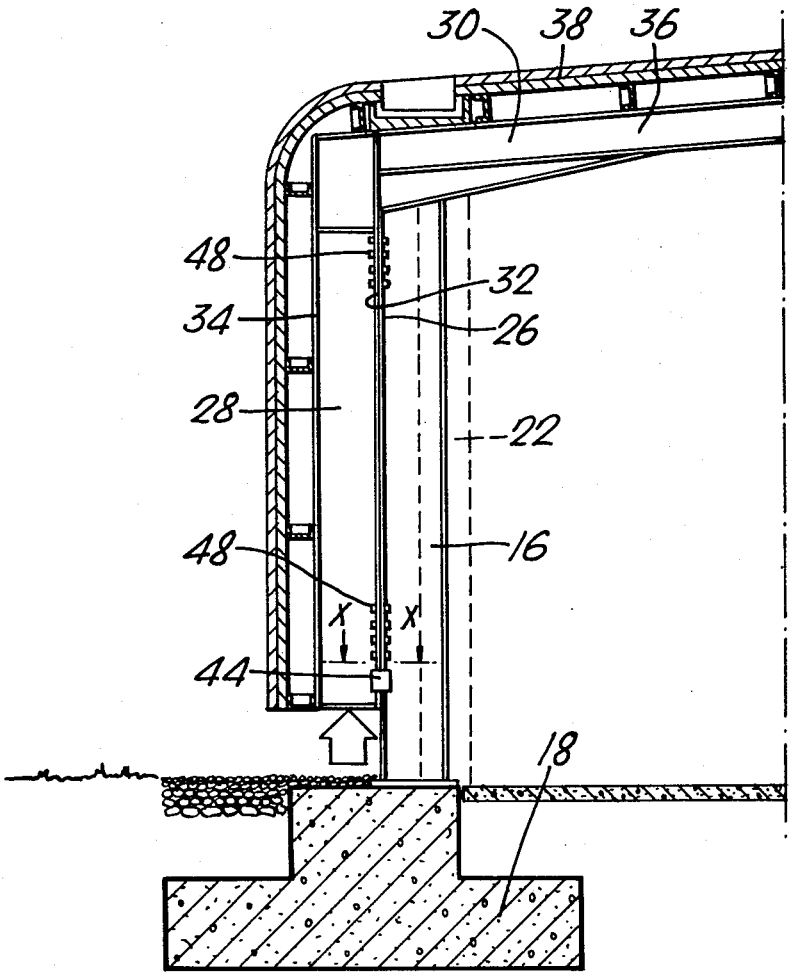
FIGS. 6 and 7 are more detailed sectional views of a portion of the building in different conditions.
Figure 7:
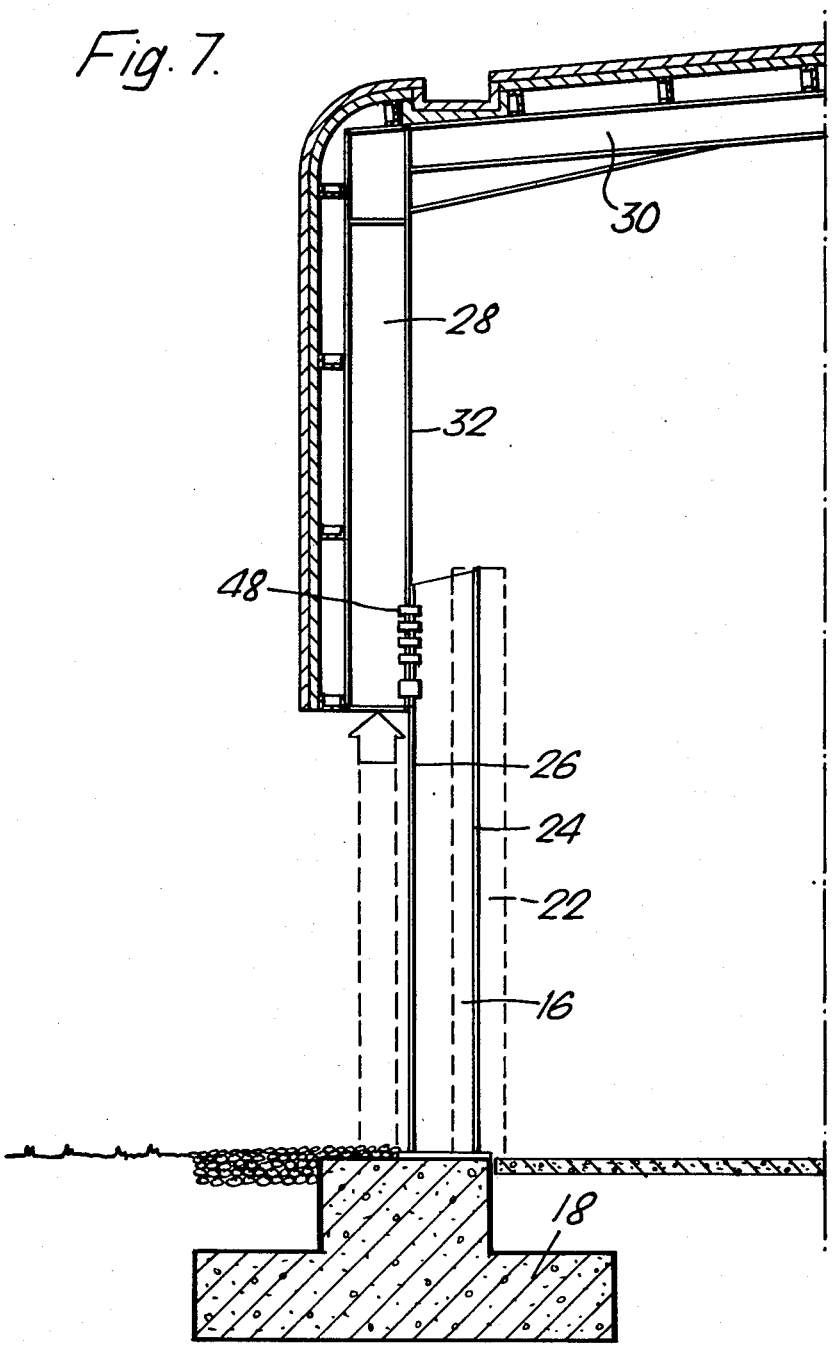

The lower portion 12 of the building comprises a plurality of rolled steel stanchions 16 embedded in concrete foundations 18 (see FIGS. 6 and 7). Braces 20 are mounted between the stanchions 16 to provide stability, and a conventional form of cladding 22 is supported against the interior sides of the stanchions 16 for weatherproofing.

Appropriately positioned openings in the cladding 22 serve for doors and windows.

The stanchions 16 are H-shaped in section and arranged with one side 24 of the H supporting the cladding and with the other side 26 projecting outwardly beyond the cladding. The sides 26 are maintained in slideable engagement with corresponding rolled steel beams 28 forming the limbs of a plurality of portal frames 30. Like the stanchions 16, the beams 28 are H-shaped in section and they are arranged so that one side 32 of the H overlies the side 26 of the associated stanchion 16. The other, exterior, side 34 and the outer edge of the overhead member 36 of the portal frame 30 carry a conventional form of cladding 38.

The upper portion 14 may have braces 40 permanently provided between the beams 28 to give it stability; or it may be devoid of such braces when lowered and only have them fixed in place when it is in the raised condition.

Openings 42 in the cladding 38 are supplied for windows and doors. These openings may be permanent or they may be covered over with cladding 38 and opened up according to the current needs of the occupier. In any event, however, when the upper portion 14 is in the lowered condition, suitably sited openings 42 are provided to coincide with the access openings to the lower portion 12.

In order to locate the portal frames 30 relative to the stanchions 16 at all times, at least one pair of guides 44 is arranged to act between each stanchion 16 and the associated beam 28. Since the arrangement is the same in each case, only one will be described.

Figure 8:
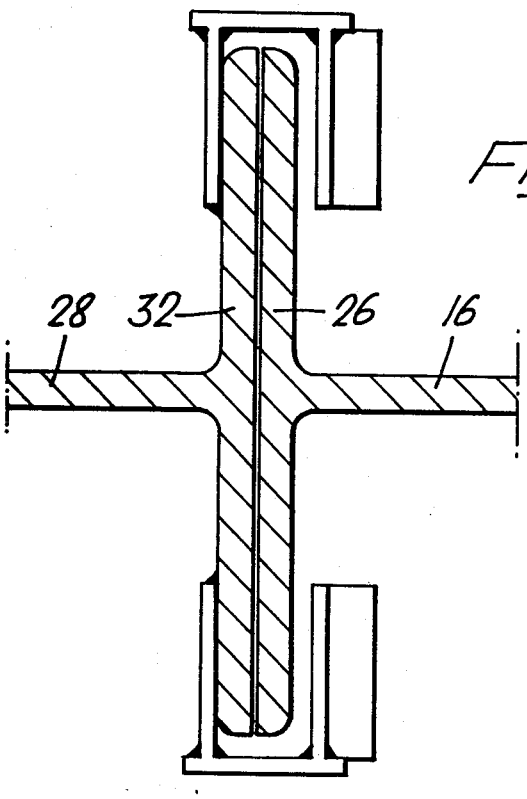
FIGS. 8 and 9 are sections taken along the line X—X in FIG. 6 in different conditions of the building.
Figure 9:
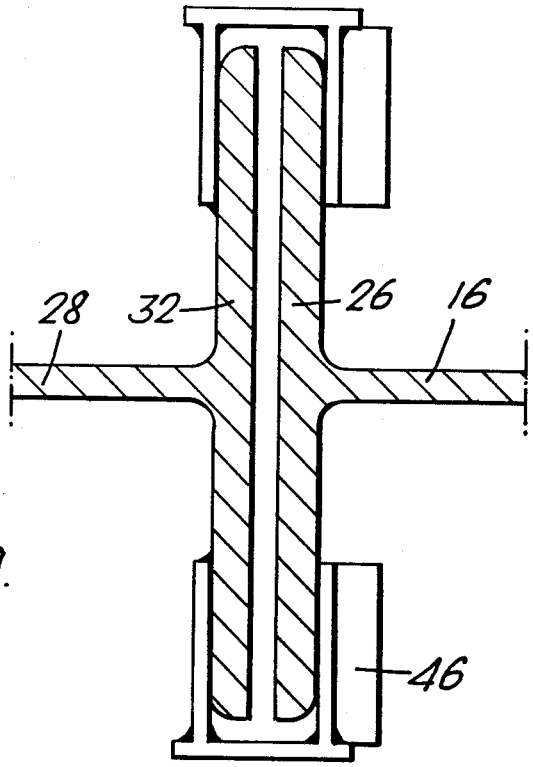
Figure 10:
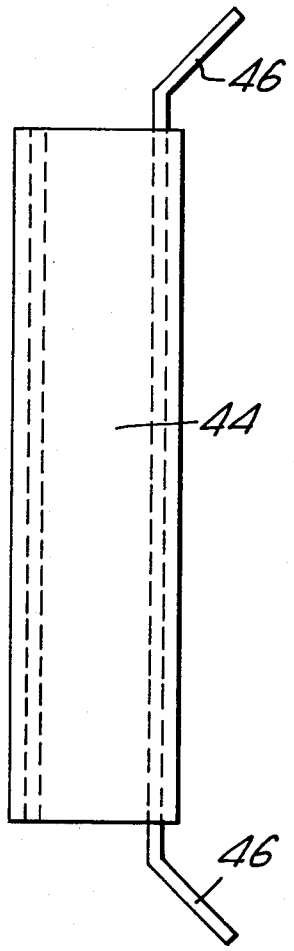
FIG. 10 is a side view of one of the guides illustrated in FIGS. 8 and 9.

In this instance, the guides 44 are situated at the lower end of the beam 28 so as to co-operate with its inner side 32 and the outer side 26 of the stanchion 16. Each guide 44 is in the form of a U-shaped slide as shown in FIGS. 8 to 10. The slides 44 embrace the sides 26, 32 and are secured to the sides 32 as by welding, but are not in any way attached to the sides 26.

Consequently, the slides 44 are arranged to guide the beam 28 for sliding along the stanchion 16, and to facilitate such movement the longitudinal ends 46 of the portion of each slide embracing the side 26 are raised away from that side. Additionally, the slides 44 serve not only to limit movement of the beam 28 outwardly from the stanchions 16 but also to restrict lateral movement of these elements relative to one another.

For fixing the upper portion 14 in its position, either raised or lowered, one or more sets of bolts or clamps 48 are fixed between the stanchions 16 and the beams 28 to engage their sides 26 and 32.

When the upper portion 14 is in its lowered position, the portal frames 30 are supported on the free upper ends of the stanchions 16, and the bolts or clamps 48 secure the limbs 28 against the tops and the bottoms of the stanchions 16. In this condition, the lower ends of the beams 28 are spaced a short distance above portions of the foundations 18.

In order to raise the upper portion 14, the following procedure is adopted:

Braces are fixed between the portal limbs, if not already present. And any cladding that needs altering or removing is dealt with.

Jacks are then temporarily inserted between the foundations 18 and the portal limbs 28 at some or all of the available points around the building. These jacks are fixed in position, connected up to power supplies and fully tested. Following this, they are inflated to take the load of the upper portion 14, but not further.

The guides 44 are then lubricated for ease of sliding and any potential obstructions are removed.

Next, the means securing the portal frames 30 to the stanchions 16 are eased, at the top first, and then at the bottom, after which they are removed.

The jacks are now inflated simultaneously in one or more stages to raise the upper portion 14 to the desired position, whereupon the portal frames 30 and stanchions 16 are fixed together again. Finally, the jacks are released.

Lowering of the upper portion 14 is a similar exercise, although it is preferable to make any adjustments required in the cladding and bracing at the end.

The height of the building can thus be adjusted as desired and by making appropriate alterations in the interior, the building can be converted for example from one to two stories or from a small to a much increased storage volume.

Any services are preferably arranged on a ring system, either with freely connectable extensions or with spare line capacity as appropriate to accommodate alterations. Additional cladding is also provided to seal between the upper and lower portions of the building.

Figure 11:
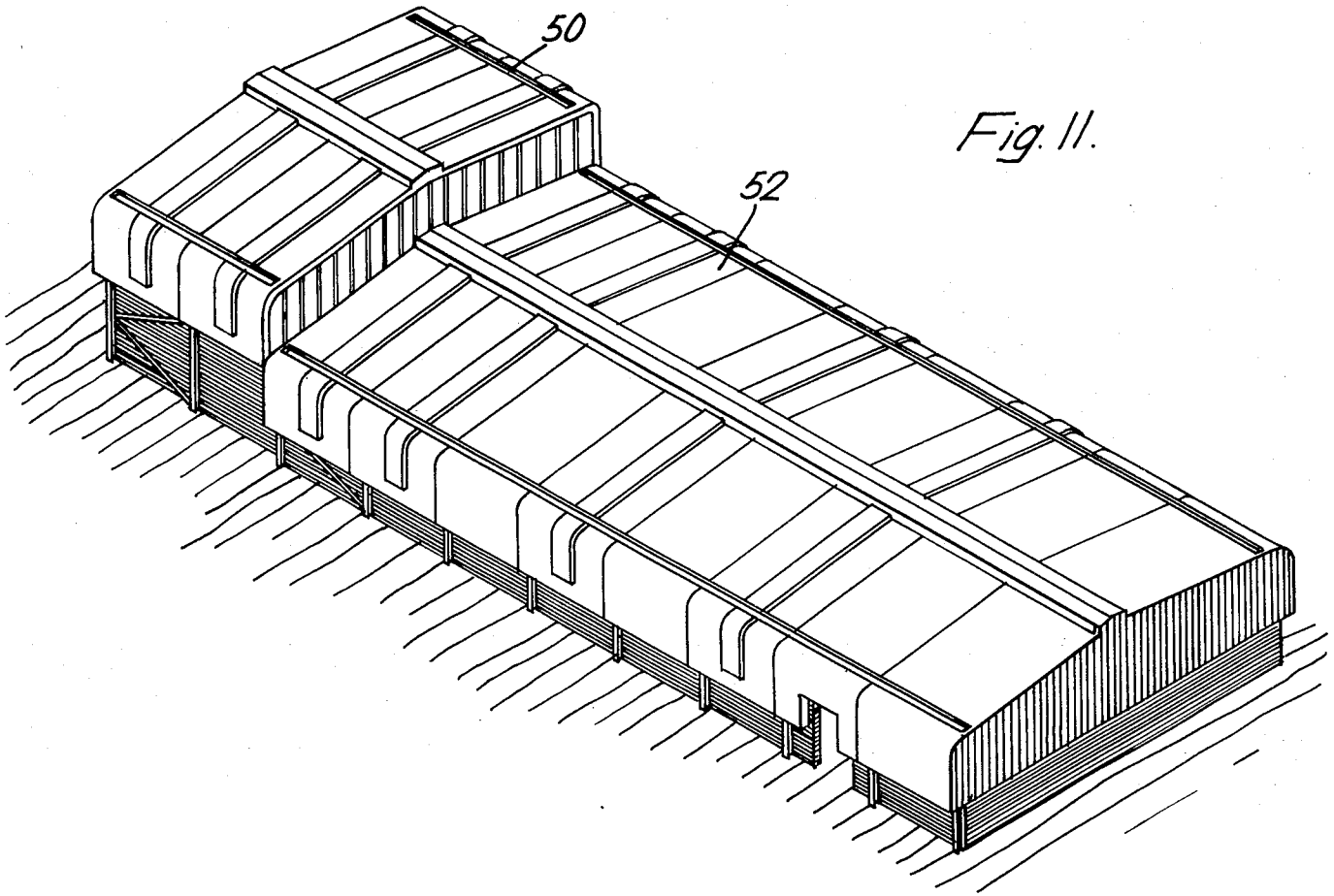
FIG. 11 is a perspective view of another building embodying the invention.
Figure 12:
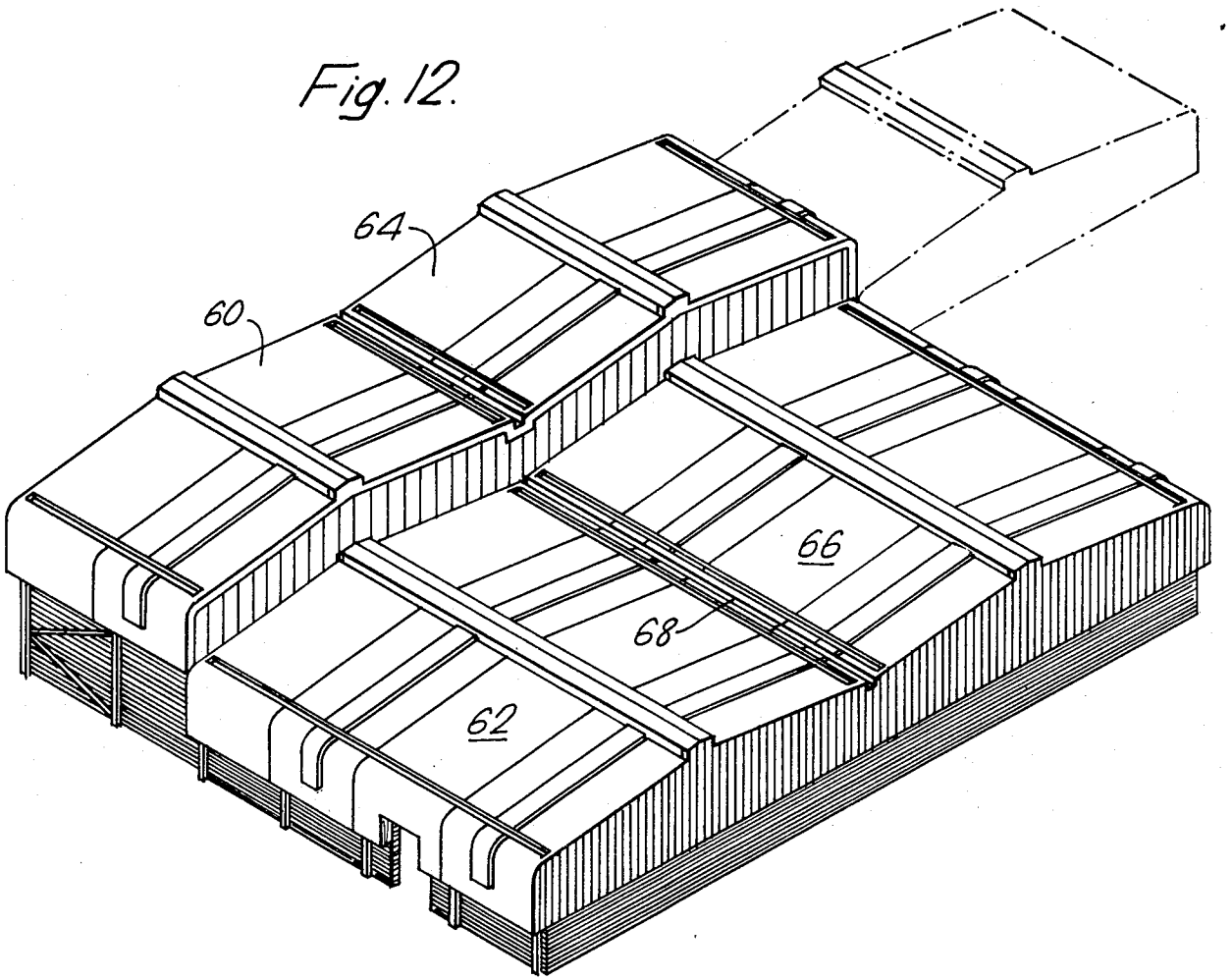
FIG. 12 is perspective view of a further building embodying the invention.

Turning to FIG. 11, this illustrates a modified form of the building which has two independently adjustable sections 50, 52.

Each of these is constructed in a manner similar to that described with reference to FIGS. 1 to 10 and so further explanation is not required except to say that when the upper portion of one section is raised while that of the other remains lowered, as shown, additional cladding will have to be added to close the vertical gap created between the two.

Figure 1:
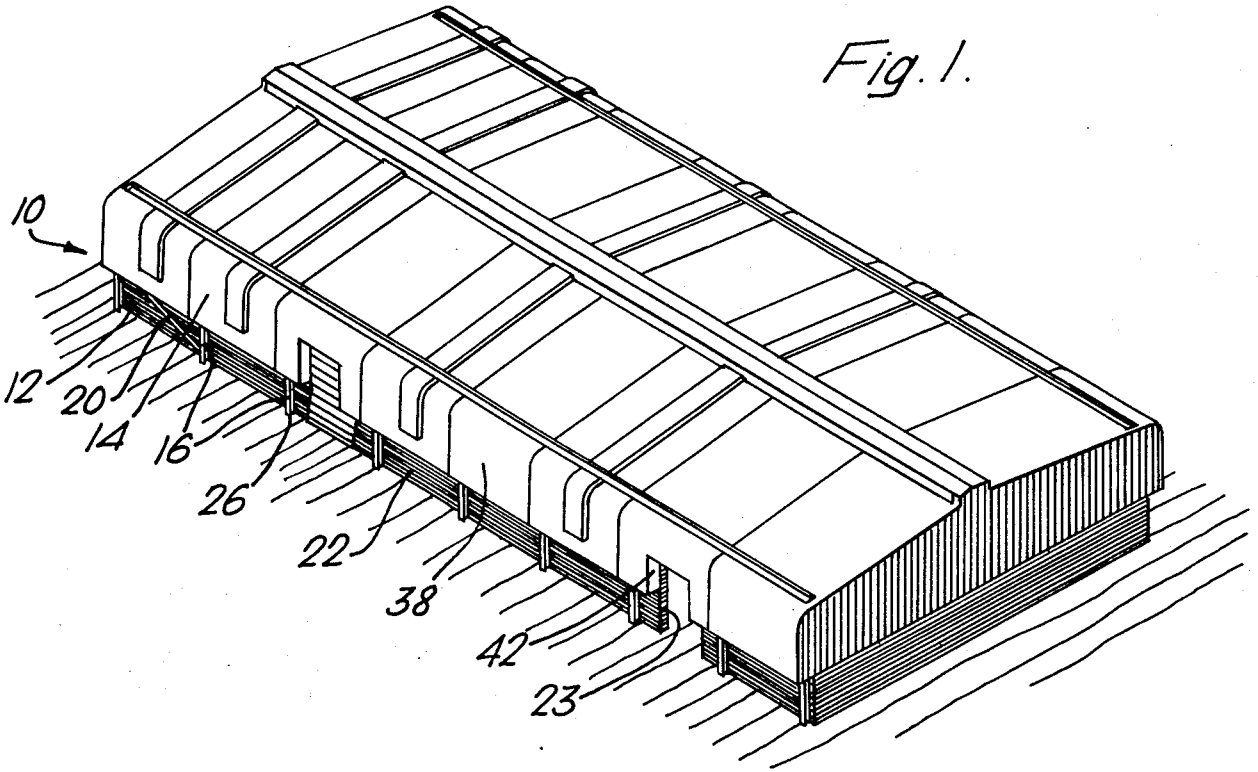
FIG. 1 is a perspective view of a first building embodying the invention.
Figure 2:
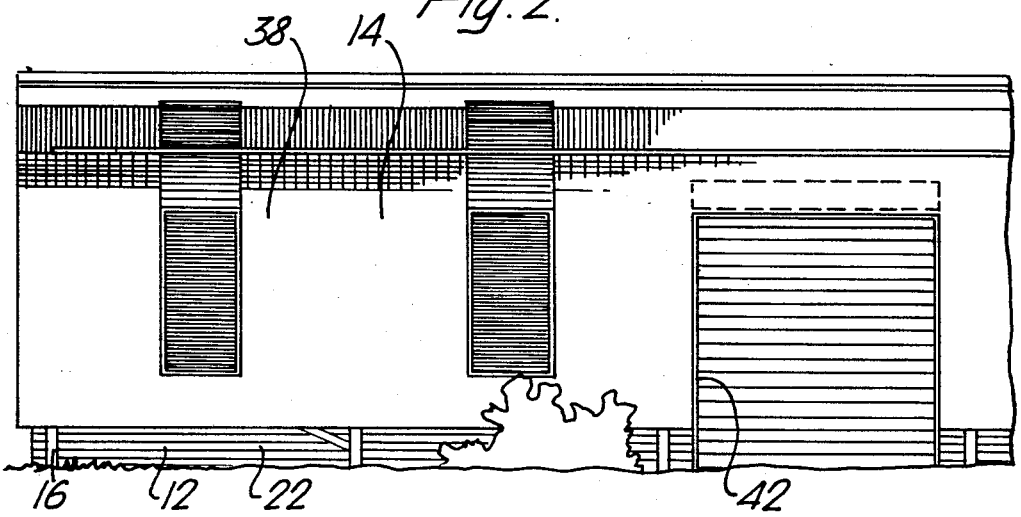
FIGS. 2 and 3 are fragmentary side views of the building in different conditions.

The buildings shown in FIGS. 1 and 11 each have only a single span. FIGS. 12 to 15 concern a multispan building, having as many as four independently adjustable sections 60, 62, 64 and 66.

Figure 13:
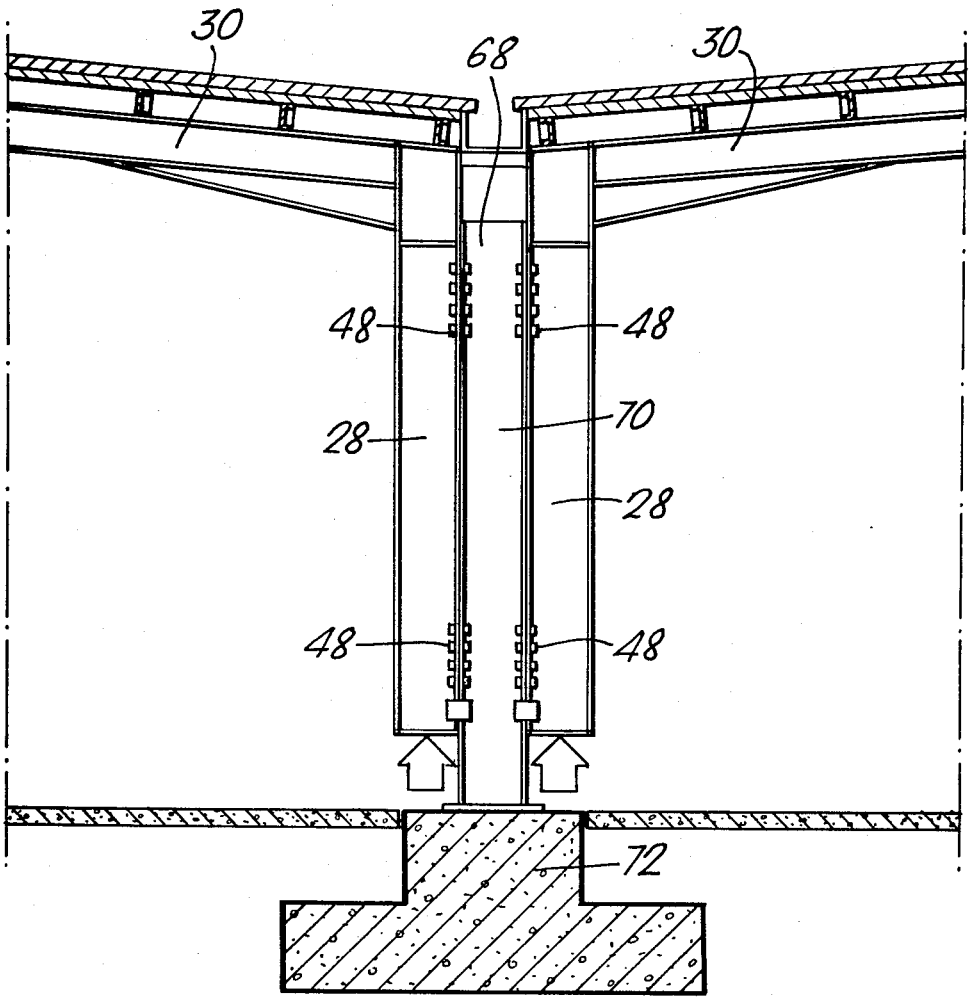
FIGS. 13, 14 and 15 are detailed sectional views of a portion of the building shown in FIG. 12 in different conditions.
Figure 14:
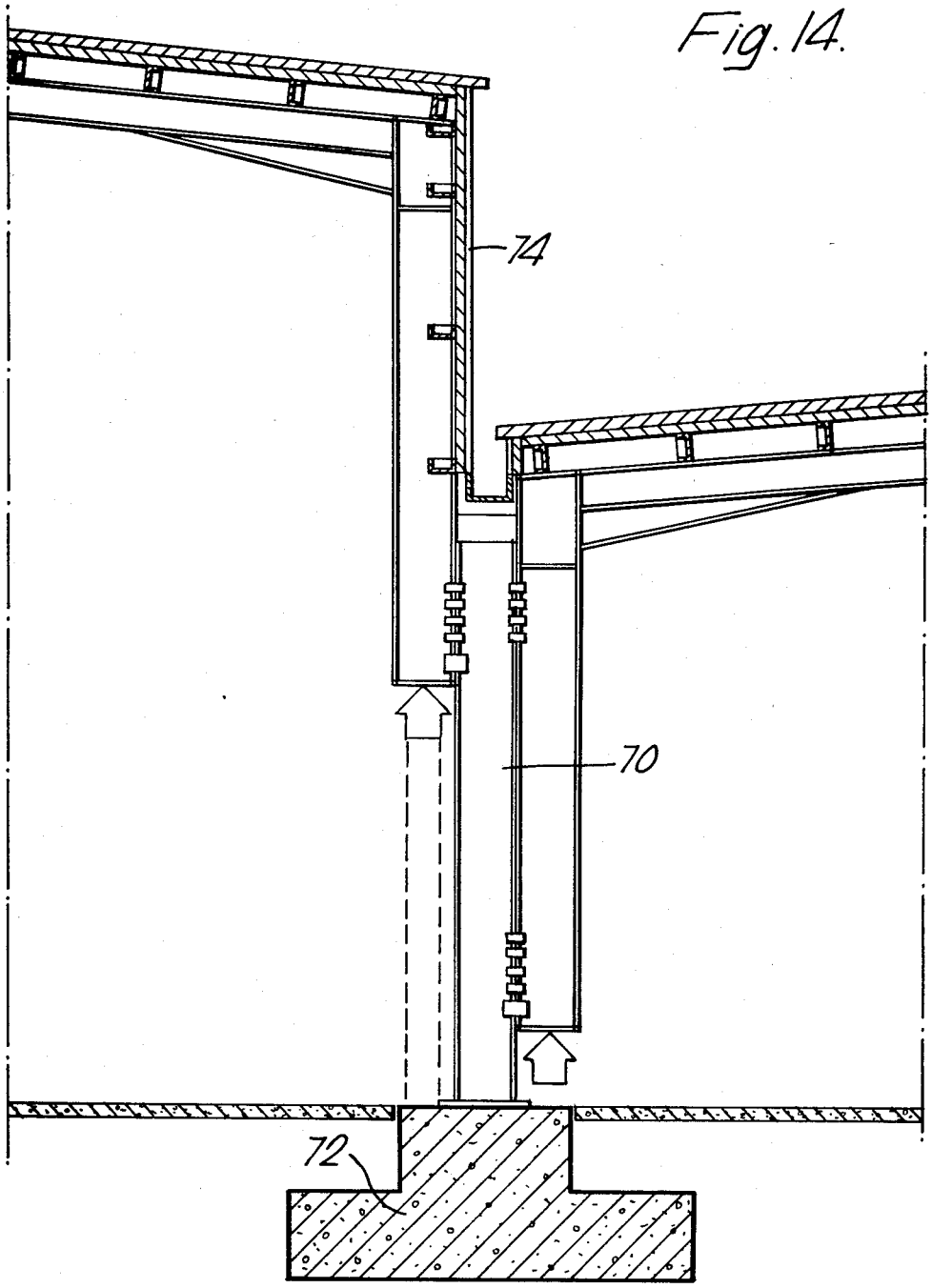
Figure 15:
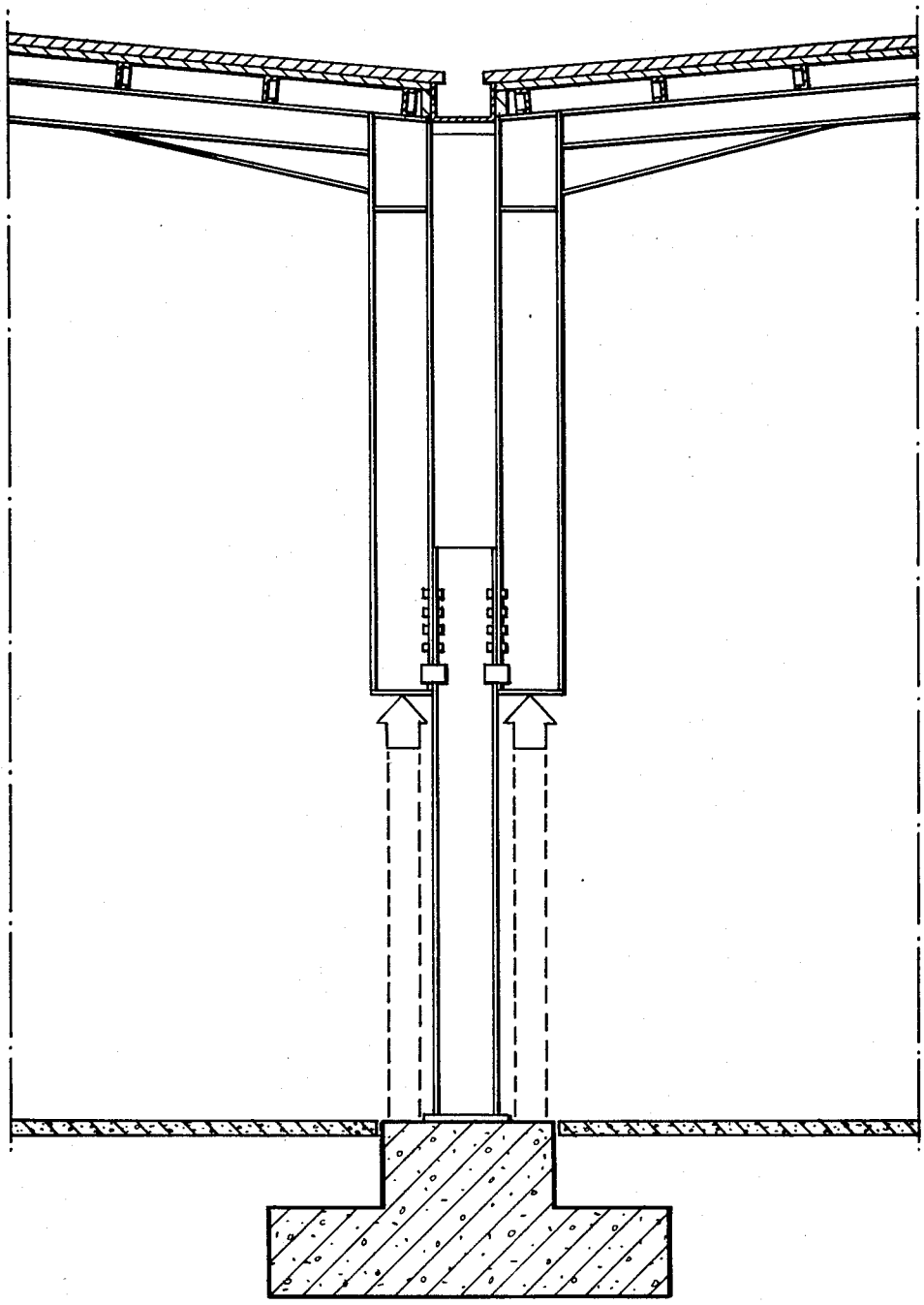

The principle of construction and the manner of raising and lowering the upper portions remains the same, but the region 68 defining the joint between the two spans is adapted to permit alterations in height of sections of one span independently of sections of the other (see FIGS. 13 to 15).

In this region 68, there are a plurality of free standing stanchions 70, which are H-shaped in cross-section, embedded centrally within foundations 72. Respective limbs 28 of the portals 30 of one span are located by their guides 44 against the stanchions 70 on one side. Likewise, respective limbs 28 of the portals 30 of another span are located by the guides 44 against the stanchions 70 on the other side. As before, bolts or clamps 48 serve to secure each limb 28 against the adjacent side of the associated stanchion 70 in the desired position.

Each span can be raised or lowered independently of the other simply by placing jacks on the foundations 72 under some of all of the relevant portal limbs 28. Of course, if one span is raised while the other remains lowered, it will be necessary to apply cladding 74 to the raised span as illustrated in FIG. 14 for weatherproofing.

The described structures have a high degree of adaptability, but can still be constructed simply in a weathertight manner. They remain rigid and stable in all conditions and are consequently suitable for industrial, leisure and indeed many other uses.

We claim:

1. A building structure comprising an outer shell having adjustable dimensions and arranged to define a substantially enclosed space, the outer shell having a section at least which comprises:

a rigid lower frame defining a lower shell portion, a rigid upper frame defining an upper shell portion, the upper shell portion being movable relative to the lower shell portion between a lowered position in which the two shell portions overlap to a substantial extent and a raised position in which the two shell portions overlap to a lesser extent, means for fixing the upper shell portion relative to the lower shell portion in the raised position at least, said lower and upper frames including structural beams arranged with the beams of one frame slidably engaging the beams of the other frame, further comprising guide means, and in which the beams comprise H-section beams, each having two sides and a central web connecting the two sides, said beams being arranged in pairs with a respective side of one beam in each pair being held in slidable engagement with a respective side of the other beam in the same pair by the guide means.

2. A structure according to claim 1, in which at least one of the beams in each pair has a free end which is held in slideable engagement with the other beam in the same pair by the guide means.

3. A structure according to claim 1, in which the guide means comprise a plurality of guides, each having a substantially U-shaped section, and in which the slideably engaging sides of the beams in each pair have edges over which the guides are fitted.

4. A structure according to claim 3, in which each guide has a first limb fixed to the respective side of one beam in the associated pair and a second limb disposed for one of sliding and rolling engagement with the respective side of the other beam in the associated pair.

5. A permanent, non-transportable building structure which is constructed on site from component materials comprising an outer shell arranged to define a substantially enclosed usable space of adjustable dimensions, a section at least of the outer shell having a rigid lower frame including structural beams permanently mounted in foundations and defining a lower shell portion, a rigid upper frame defining an upper shell portion and including structural beams arranged slidably to engage the structural beam of the lower frame, wherein each of the structural beams is formed with a longitudinal side flange and the structural beams are arranged in slidably engaged pairs with the side flanges of the beams in each pair being arranged adjacent and generally parallel to one another for relative sliding movement and guide means are provided for fitting around the edges of adjacent side flanges of the beams in an associated pair for holding the beams in sliding engagement, the upper shell portion being slidable relative to the lower shell portion between a lowered position in which the two shell portions overlap to a substantial extent and a raised position in which the two shell portions overlap to a lesser extent, and means for fixing the upper shell portion relative to the lower shell portion in the raised position at least.

6. A structure according to claim 5, wherein the beams comprise H section beams, each having two sides providing the side-flanges and a central web connecting the two sides.

7. A structure according to claim 6, wherein the guide means comprises a plurality of guides, each being substantially U-shaped in cross-section, and which are fitted over adjacent edges of the slidably engaging sides of the beams in each associated pair.

8. A structure according to claim 7, wherein each guide has a first limb fixed to the respective side of one beam in the associated pair and a second limb disposed for sliding or rolling engagement with the respective side of the other beam in the associated pair.

9. A structure according to claim 5, wherein the guide means comprises a plurality of guides, each being substantially U-shaped in cross-section, and which are fitted over adjacent edges of the slidably engaging sides of the beams in each associated pair.

10. A structure according to claim 9, wherein each guide has a first limb fixed to the respective side of one beam in the associated pair and a second limb disposed for sliding or rolling engagement with the respective side of the other beam in the associated pair.

11. A structure according to claim 5, wherein at least one of the beams in each associated pair has a free end which is held in slidable engagement with the other beam in the same pair by the guide means.

12. A structure according to claim 5, wherein the upper frame includes a plurality of portal frames providing the structural beams of the upper frame.

13. A structure according to claim 5, wherein the upper frame and the foundations are arranged for receiving jacks therebetween for raising and lowering the upper shell portion.

14. A structure according to claim 5, further comprising means for fixing the upper shell portion relative to the lower shell portion in the lowered position.

15. A structure according to claim 5, comprising a plurality of independently adjustable sections.

* * * * *